US010597802B2

(12) United States Patent
Borer et al.

(10) Patent No.: US 10,597,802 B2
(45) Date of Patent: Mar. 24, 2020

(54) LOOM FOR PRODUCING WOVEN MATERIAL, HAVING INCORPORATED KNITTING THREADS OR COVER THREADS

(71) Applicant: Textilma AG, Stansstad (CH)

(72) Inventors: Silvan Borer, Frick (CH); Bernhard Engesser, Niederwil (CH)

(73) Assignee: Textilma AG (CH)

( * ) Notice: Subject to any disclaimer, the term of this patent is extended or adjusted under 35 U.S.C. 154(b) by 137 days.

(21) Appl. No.: 15/763,866

(22) PCT Filed: Aug. 18, 2016

(86) PCT No.: PCT/EP2016/069656

§ 371 (c)(1),
(2) Date: Sep. 4, 2018

(87) PCT Pub. No.: WO2017/042015

PCT Pub. Date: Mar. 16, 2017

(65) Prior Publication Data

US 2018/0363170 A1 Dec. 20, 2018

(30) Foreign Application Priority Data

Sep. 10, 2015 (EP) ..... 15184654

(51) Int. Cl.
*D03D 13/00* (2006.01)
*D03D 31/00* (2006.01)
(Continued)

(52) U.S. Cl.
CPC ..... *D03D 13/002* (2013.01); *D03D 21/00* (2013.01); *D03D 31/00* (2013.01); *D03D 35/00* (2013.01);
(Continued)

(58) Field of Classification Search
CPC ..... D03D 35/00; D03D 31/00; D03D 25/005; D03D 2700/10; D03D 2700/105;
(Continued)

(56) References Cited

U.S. PATENT DOCUMENTS 1,065,555 A * 6/1913 Schweser ..... D03D 31/00 139/49
2,800,927 A * 7/1957 Silberman ..... D03D 35/00 139/383 R
(Continued)

FOREIGN PATENT DOCUMENTS

BE 1013676 A6 6/2002
CH 490541 A 5/1970
(Continued)

OTHER PUBLICATIONS

Written Opinion of the International Searching Authority in related PCT/EP2016/069656.

*Primary Examiner* — Robert H Muromoto, Jr.
(74) *Attorney, Agent, or Firm* — George Pappas

(57) ABSTRACT

In order to provide a weaving loom having incorporated knitting threads, it is provided that the corresponding device for incorporating knitting threads comprises a feeding device for each knitting thread and, also for each knitting thread, a dipping guide needle (4) which comprises a thread guiding eye and which can be dipped between warp threads (2, 3) into the shed all the way below the insertion path of the weft-insertion device (7). Each one of the dipping guide needles (4) is slidingly arranged transversely to the warp direction, thus being able to move across the width of the woven material. Furthermore, there is provided a combing shaft (10) that comprises a plurality of teeth with intermediate spaces arranged therebetween for guiding the knitting threads. The combing shaft (10) that is slidable transversely to the direction of the warp thread and is rotatable around an
(Continued)

axis in the direction of the rail is arranged transversely to the direction of the warp thread behind the stop position of the reed. The teeth of the combing shaft comprise protrusions which are designed in such manner that the teeth can retain the knitting threads in at least one rotational position of the combing shaft.

21 Claims, 19 Drawing Sheets

(51) Int. Cl.
*D03D 35/00* (2006.01)
*D03D 47/04* (2006.01)
*D03D 21/00* (2006.01)
*D03D 41/00* (2006.01)

(52) U.S. Cl.
CPC ..... *D03D 47/04* (2013.01); *D03D 2700/10* (2013.01)

(58) Field of Classification Search
CPC ..... D03D 41/00; D03D 41/004; D03D 47/04; D03D 47/06; D03D 47/08; D03D 47/265; D03D 23/00; D03D 2700/01; D03D 49/68; D03D 13/002; D03D 21/00
See application file for complete search history.

(56) References Cited

U.S. PATENT DOCUMENTS 3,796,234 A * 3/1974 Muller ..... D03D 23/00 139/46
3,914,822 A * 10/1975 Wood ..... D21H 5/2628 425/81.1
3,993,817 A * 11/1976 Schultz ..... D03D 3/00 428/66.5
4,105,052 A * 8/1978 Trost ..... D03D 41/00 139/101
4,123,832 A * 11/1978 Schultz ..... C04B 35/83 156/148
4,378,820 A * 4/1983 Lileev ..... D03D 47/265 139/192
4,531,553 A * 7/1985 Steiner ..... D03D 41/005 139/28
4,614,209 A * 9/1986 Steiner ..... D03D 41/005 139/11
5,174,341 A * 12/1992 Steiner ..... D03D 41/005 139/11
5,767,023 A * 6/1998 Berger ..... B29C 70/24 139/384 R
5,768,916 A * 6/1998 Borer ..... D04B 7/26 66/204
5,947,162 A * 9/1999 Steiner ..... D03D 41/005 139/1 C
5,956,978 A * 9/1999 Dorn ..... D04B 27/26 66/207
2007/0119142 A1* 5/2007 Buhler ..... D03C 5/00 57/1 R
2019/0264355 A1* 8/2019 Engesser ..... D03D 47/06

FOREIGN PATENT DOCUMENTS

EP 0263392 A2 4/1988
EP 2395140 A1 12/2011
JP S5576137 A 6/1980
JP 2005015954 A 1/2005
JP 2007031884 A 2/2007
WO 2007071077 A1 6/2007
WO 2013107571 A2 7/2013

* cited by examiner

Z
Z
Z

LOOM FOR PRODUCING WOVEN MATERIAL, HAVING INCORPORATED KNITTING THREADS OR COVER THREADS

This application claims priority from PCT application No PCT/EP2016/069656 filed Aug. 18, 2016 which claims priory from European application No. EP 15184654.0 filed on Sep. 10, 2015, the disclosures of which are incorporated herein by reference.

TECHNICAL FIELD

The invention relates to a weaving loom for producing a woven material with incorporated knitting threads or cover threads.

BACKGROUND OF THE INVENTION

A weaving loom of the above-mentioned type is known from CH 490 541. Therein, attachment threads are arranged by means of feed needles while weaving a ribbon. There are no suggestions whatsoever as to how the ribbon needle weaving loom could carry out in advantageous manner the incorporation of knitting threads or cover threads. A similar technology has been independently disclosed in U.S. Pat. No. 3,796,234 A.

From WO 2007/071077 A1 it is known to incorporate a conductive thread in various ways by having the feed needle arranged on a shaft that is oriented transversely to the wrap direction, the shaft being connected to a first driving device for performing a pivoting movement of the shaft and it further being connected to a second driving device for effecting a displacement in axial direction. As a result of pivoting, the guide dips into and out of the shed. As a result, the guide can be moved across the width of the woven material, which in the case of WO 2007/071077 A1 is a ribbon.

From JP 2005/015954 A, there is known a weaving loom for weaving in an effect thread that can be incorporated in the backing fabric. The weaving loom of JP 2005/015954 A is equipped with a shed forming device for the warp threads which allows selecting individual warp threads. In this case the effect thread is a selected, additional warp thread. Thereby, both the effect thread and any additional warp threads are guided within the shed. As a result, the effect threads of the warp that is being fed in from above the additional warp threads and the selected effect thread, are tied off by these warp threads upon a transverse movement of the effect threads. This means that the effect threads are not applied above the backing fabric, but rather become a part of the backing fabric and thus modify the structure.

From EP 2 395 140 A1, there is known a weaving loom which is capable, by means of a warp-laying device that is laterally movable by one or several warp threads of the backing fabric, to bind down, onto the backing fabric, additional threads called cover threads. The weaving loom of EP 2 395 140 A1 is certainly suitable for certain applications, in particular for the applications mentioned EP 2 395 140 A1. However, in certain applications it appears necessary, on the one hand in order to provide relief to the threads, i.e. to the cover threads of EP 2 395 140 A1, and on the other hand in order to achieve greater flexibility of the weaving loom, particularly if there are several additional threads, to take measures for ensuring a clean weaving in and laying of the additional threads. For this purpose, in EP 2 395 140 A1 there is proposed a retaining hook—originally also called a blade, which, however, has nothing to do with the guide needle mentioned here and further below since it lacks the connection to the additional thread—but which is only suitable for one additional thread (cover thread) due to its low flexibility.

From WO 2013/107571 A2, there is known a weaving loom comprising a device for forming additional weft effects which, however, has proven to be disadvantageous; overcoming those disadvantages is an object of the invention. It should be noted that WO 2013/107571 A2 proposes guide needles to be arranged between reed and shed forming device which are slidable in the vertical direction and weft direction and which can bring the effect threads into the lower shed so that the weft-insertion element can be moved through the effect thread loops thus formed. A first fundamental disadvantage of this device is that the effect thread loops become progressively smaller as the shift strokes of the guide needles in the weft direction become larger. The weft-insertion element can then no longer move in a reliable manner, or it cannot move at all, through the effect yarn loop. A second fundamental disadvantage is that the reed is open towards the top and the upper frame of the reed is missing. As a consequence, the reed teeth can bend in weft direction already under the influence of a small force, which results in warp density variations in the fabric.

SUMMARY OF THE INVENTION

The object of the invention is to provide a weaving loom which is useful for producing a woven material with incorporated knitting or cover threads.

The object is achieved in the above-mentioned weaving loom by the machine as described herein. Thereby, the measures of the invention have initially the result that several threads—henceforth referred to as knitting threads—can be bound down—in weft direction. Moreover, the binding down is not visible or only hardly visible on the face of the ribbon fabric. In this manner the machine—in contrast to the weaving loom of JP 2005/015954 A—is able to incorporate a thread without noticeably changing the woven material. Through the measures of the invention it is possible that the additional threads do not become a part of the backing fabric. In this manner, the essential disadvantage of JP 2005/015954 A is avoided.

Compared to the weaving loom of EP 2 395 140 A1—also comprising a retaining hook—the weaving loom according to the present invention has the advantage of greater flexibility. Due to the interaction of the guide with a thread guiding eye, that is a dipping guide needle that dips from above between the warp threads, with the combing shaft comprising a plurality of teeth with intermediate spaces arranged therebetween, a substantially greater flexibility is achieved as compared to the weaving loom of EP 2 395 140 A1. In addition, the measures of the invention render superfluous the warp-laying device of the weaving loom of EP 2 395 140 A1 because the additionally laid threads are not introduced by means of the additional warp threads, but rather are introduced by means of the guide comprising a thread guiding eye, that means, by means of weaving. It will be obvious to a person skilled in the art that the measures of the invention achieve their advantage, in particular through the fact that the combing shaft comprising a plurality of teeth with intermediate spaces arranged therebetween is not only rotatable about its own axis as in EP 2 395 140 A1, but furthermore is laterally slidable and is additionally provided with means, preferably by comprising protrusions at the teeth, which are designed in such manner that the teeth can retain the knitting threads in at least one position of the combing shaft rotation, but release them in another position of the combing shaft rotation. In this manner, in particular, the disadvantages of WO 2013/107571 A2 can be overcome. It should be obvious to a person skilled in the art that the interaction of the combing shaft with the movement or movability of the dipping guide needle by means of the above-mentioned means, particularly the protrusions on the combing shaft, are essential in practice to allow retaining the teeth of the knitting threads in at least one position of the combing shaft but releasing them in another axial position. Thereby, a feature which is essential for the invention and helpful for implementing the invention is the embodiment of the combing shaft: The incorporated threads are retained in a rotational position of the combing shaft until the weft-insertion organ has reliably moved through the knitting thread loop. In that location, the knitting thread would slip off downwards from the teeth of the combing shaft if there were no protrusions or noses on the tooth tip to retain it. The knitting thread would then suddenly be lying diagonally across the warp, and the knitting needle loop formed by the dipping guide needle would become so small that the weft-insertion organ could no longer be moved therethrough in a reliable manner.

It is advantageous in the sense of a simple embodiment if the teeth of the insertion device are arranged next to each other at a fixed, preferably equal distance. Thereby, two or more dipping guide needles can be arranged next to each other so that two or more knitting threads, which—in the case of more than two by no means need to have the same distance—can be weaved in substantially coherent manner. However, it is also possible to arrange two or more dipping guide needles one behind the other, so that two or more knitting threads can be weaved in completely independently of each other. These two measures can be combined with each other by arranging dipping guide needles both side by side and also in succession.

It will be understood that the invention can also be used in such manner that only one dipping guide needle is activated, which means that its needle eye is provided with a thread.

The above-mentioned embodiments primarily relate to ribbon weaving looms, for example having a weft needle. On wider weaving looms, however, the technique according to the present invention can advantageously be used in such manner that a gripper or—quite conventionally a weaving boat—is provided as weft-insertion mean.

The aforementioned elements as well as those claimed and described in the following exemplary embodiments, to be used according to the invention, are not subject to any particular conditions by way of exclusion in terms of their size, shape, use of material and technical design, with the result that the selection criteria known in the respective field of application can be used without restrictions.

BRIEF DESCRIPTION OF THE DRAWINGS

Examples of the weaving loom will henceforth be described in more detail by reference to the drawings, in which are shown:

FIG. 5 the weaving loom according to FIG. 1, wherein the reed is located further away from the stop position, and the dipping guide needle is already dipped in;

FIG. 13 the weaving loom according to FIG. 12, wherein a dipping guide needle in a situation with a formed shed is ready for dipping in;

DETAILED DESCRIPTION OF THE PREFERRED EMBODIMENTS OF THE INVENTION

In FIGS. 1 to 9, the working principle of the device is described in an explanatory manner, wherein, in this example, only one dipping guide needle is activated, the needle eye thereof thus being provided with a thread.

Figure 1:
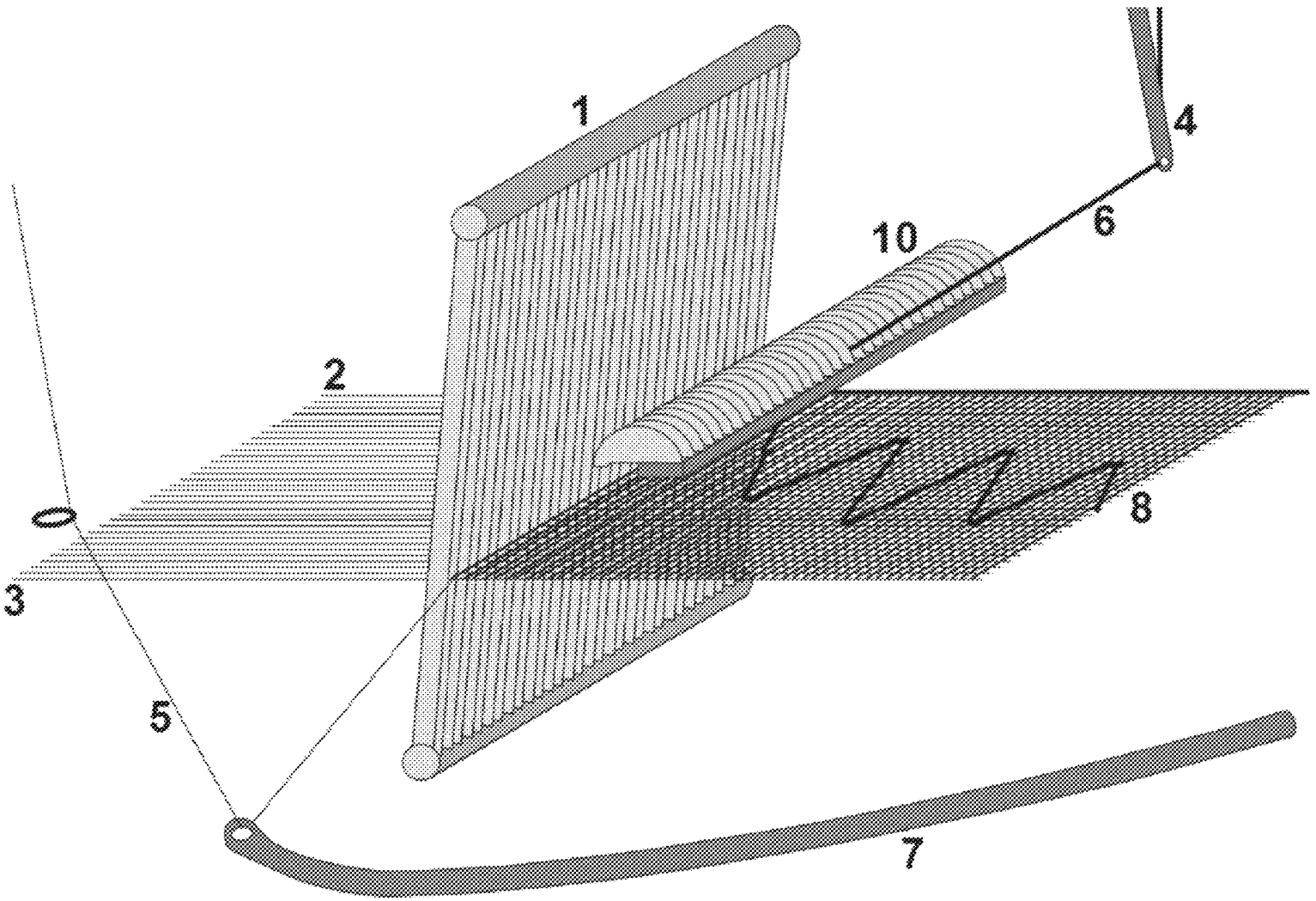
FIG. 1 a weaving loom in a perspective view, according to a first example of the present invention, substantially in a resting position.
Figure 2:
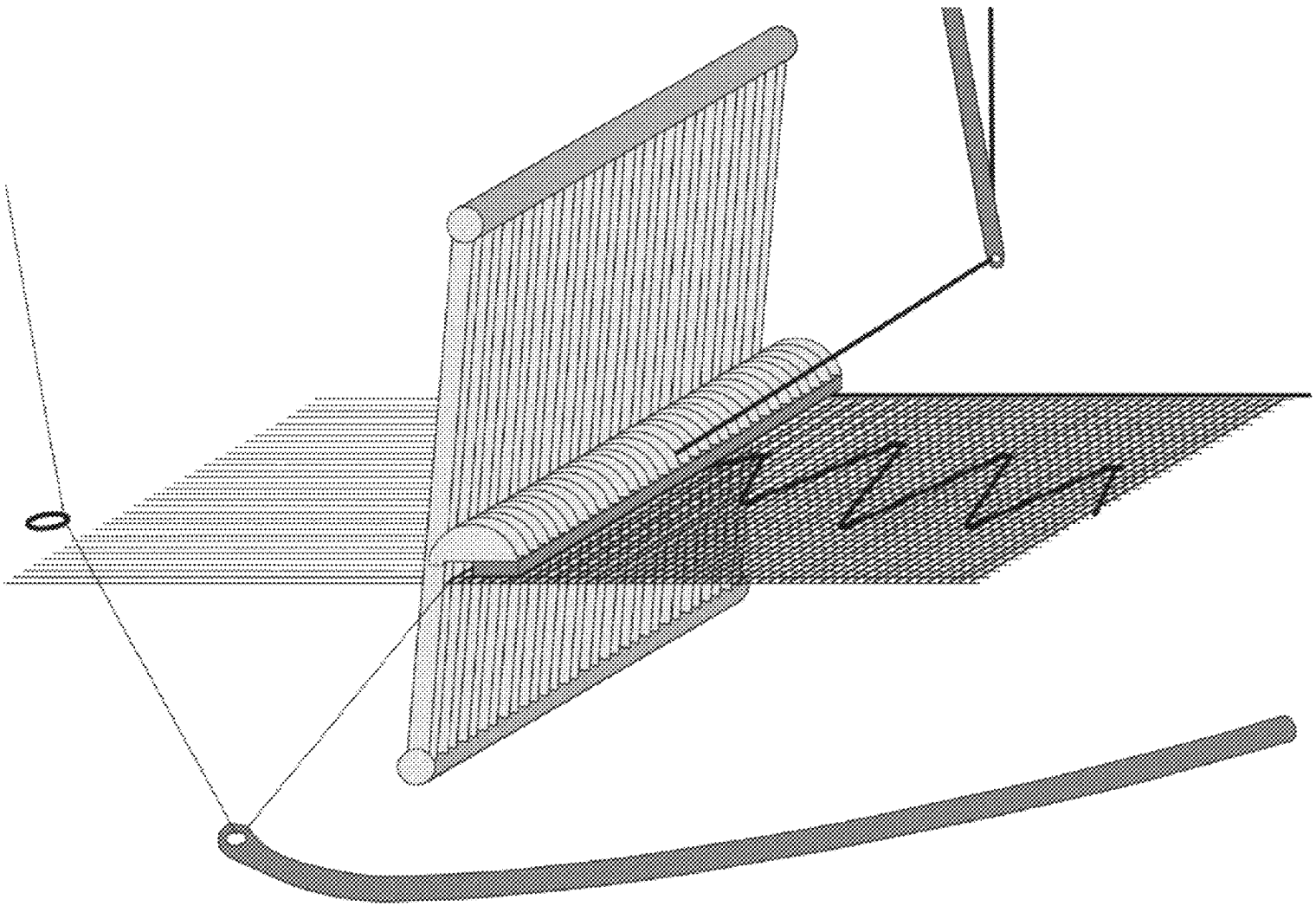
FIG. 2 the weaving loom according to FIG. 1, wherein the combing shaft and the dipping guide needle are already displaced compared to FIG. 1.
Figure 3:
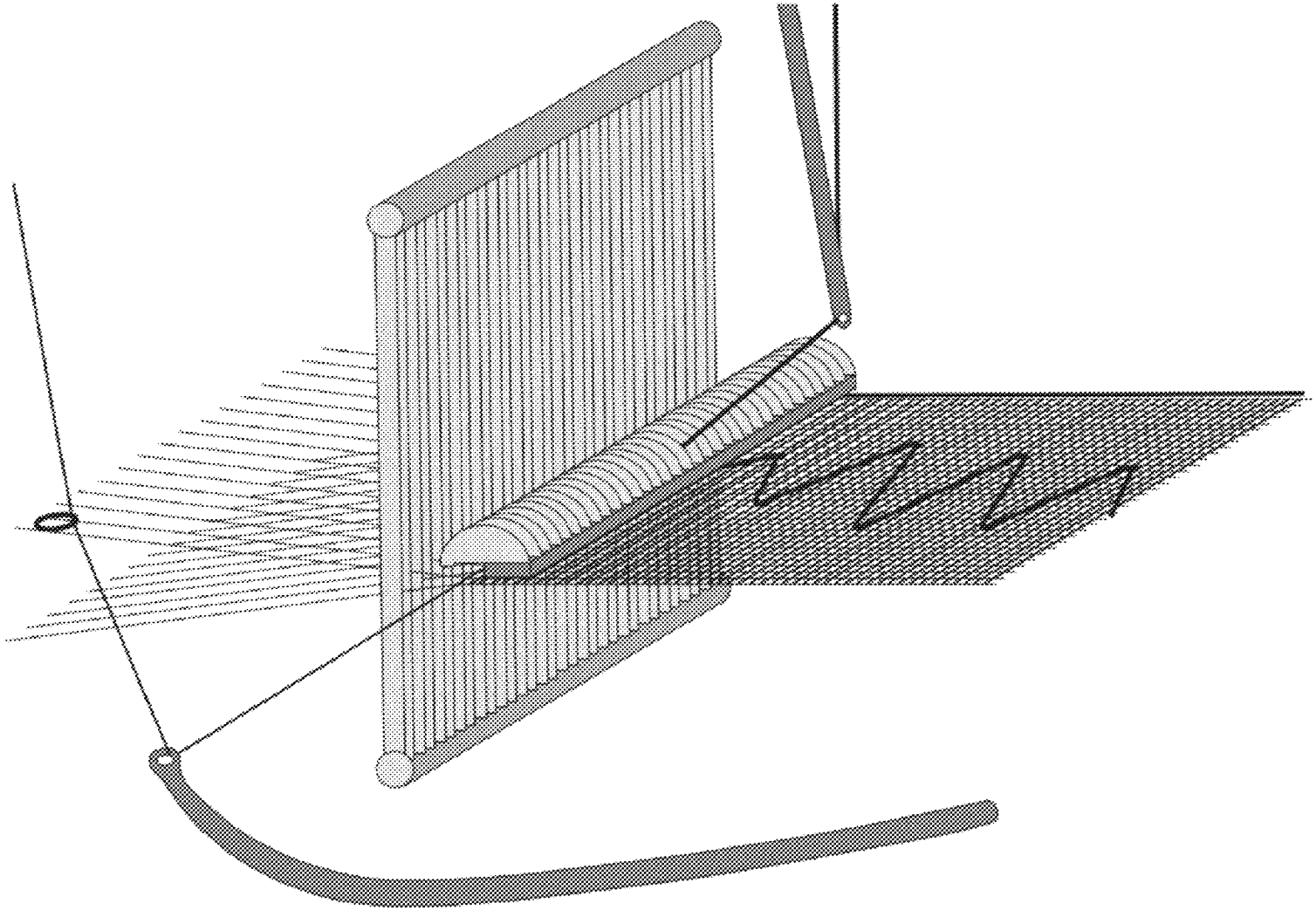
FIG. 3 the weaving loom according to FIG. 1, wherein a lower shed and an upper shed are formed and the dipping guide needle is displaced towards the combing shaft.
Figure 4:
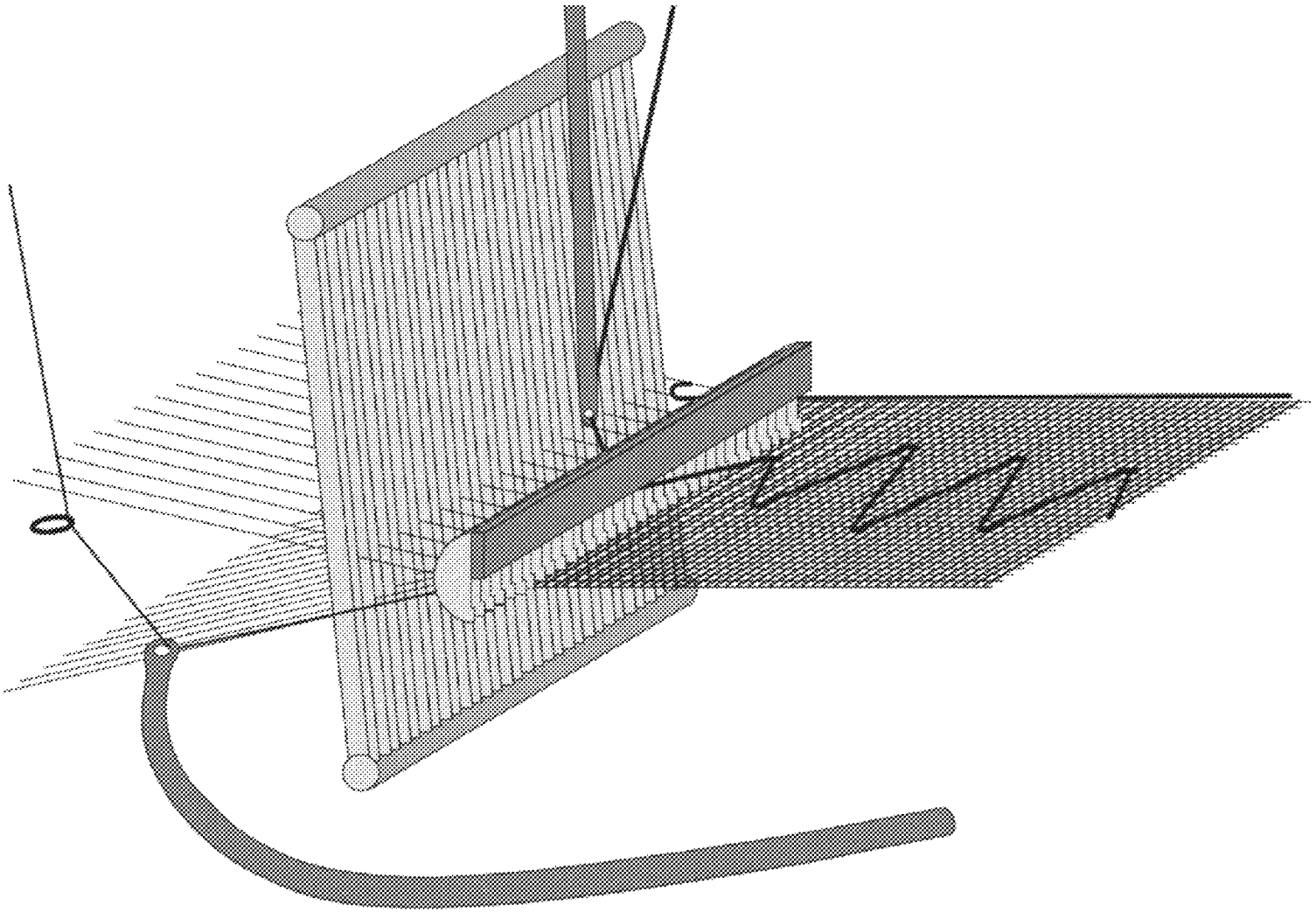
FIG. 4 the weaving loom according to FIG. 1, wherein the reed is moving away from the stop position, the dipping guide needle is ready for dipping in and the combing shaft is rotated by about 80° about its axis; the weft needle has already approached to the region between the upper shed and the lower shed.
Figure 5:
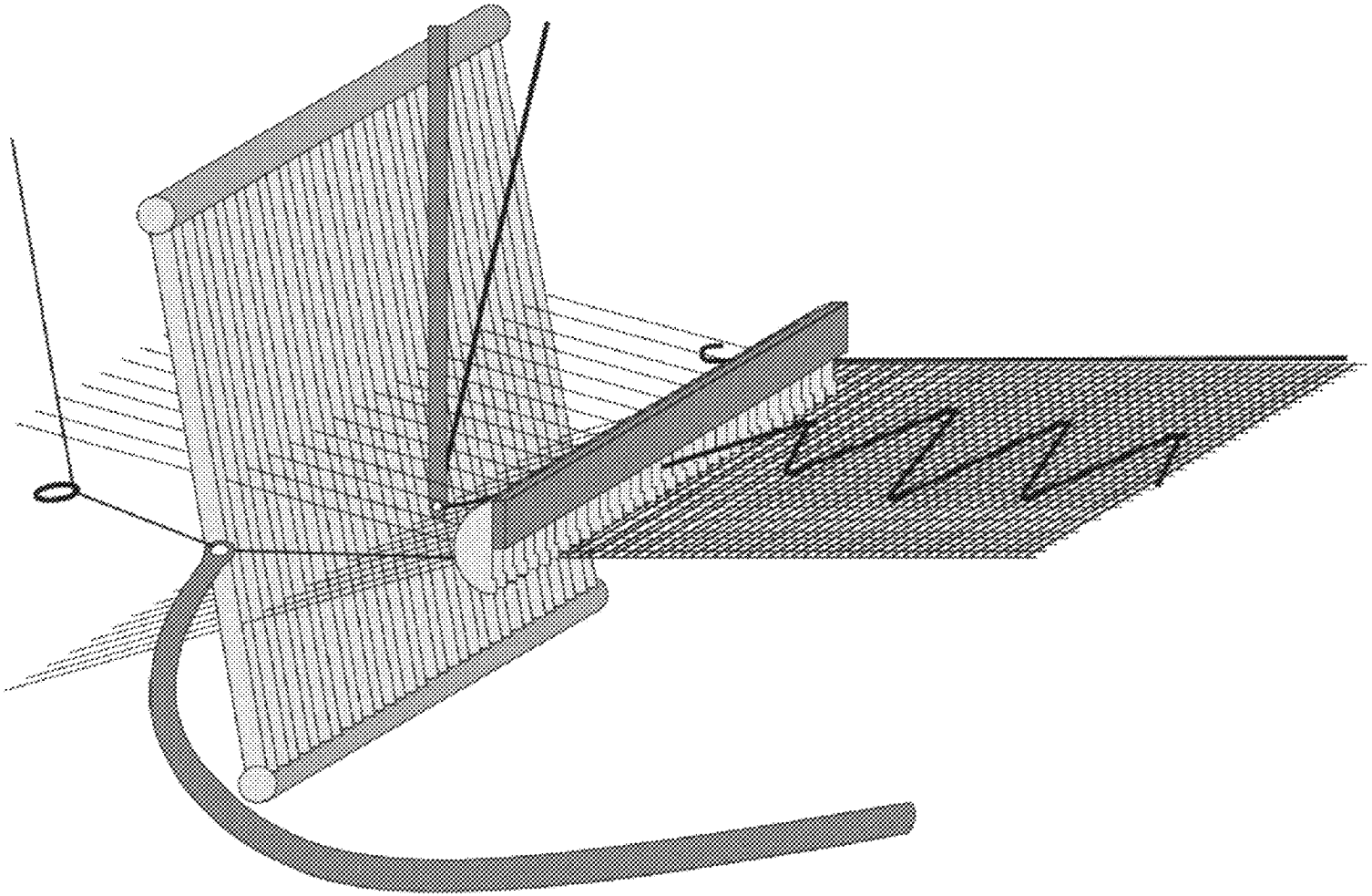
Figure 6:
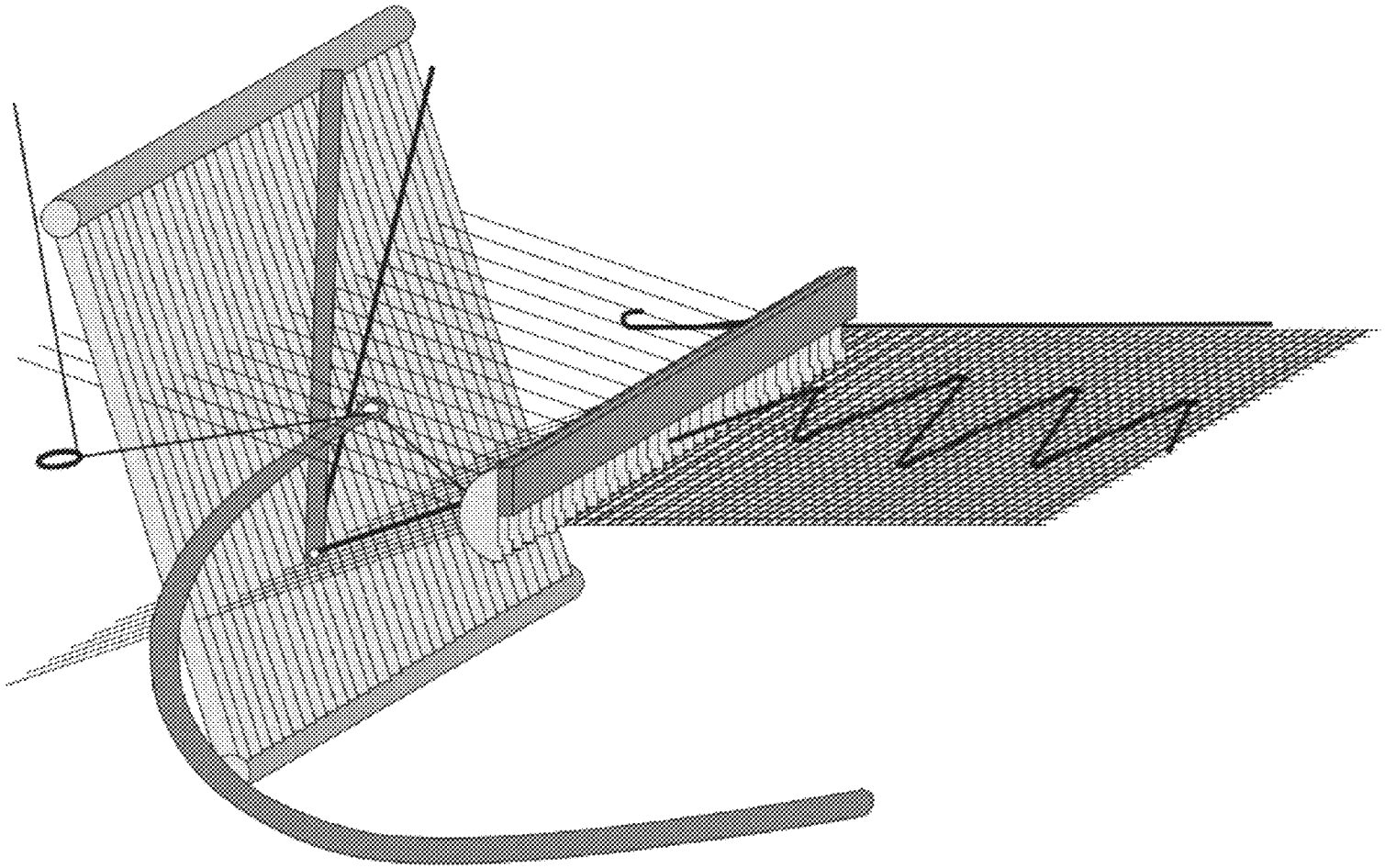
FIG. 6 the weaving loom according to FIG. 1, wherein the reed is displaced even further away from the stop position, and the dipping guide needle is already dipped in to a position below the level of the weft needle.
Figure 7:
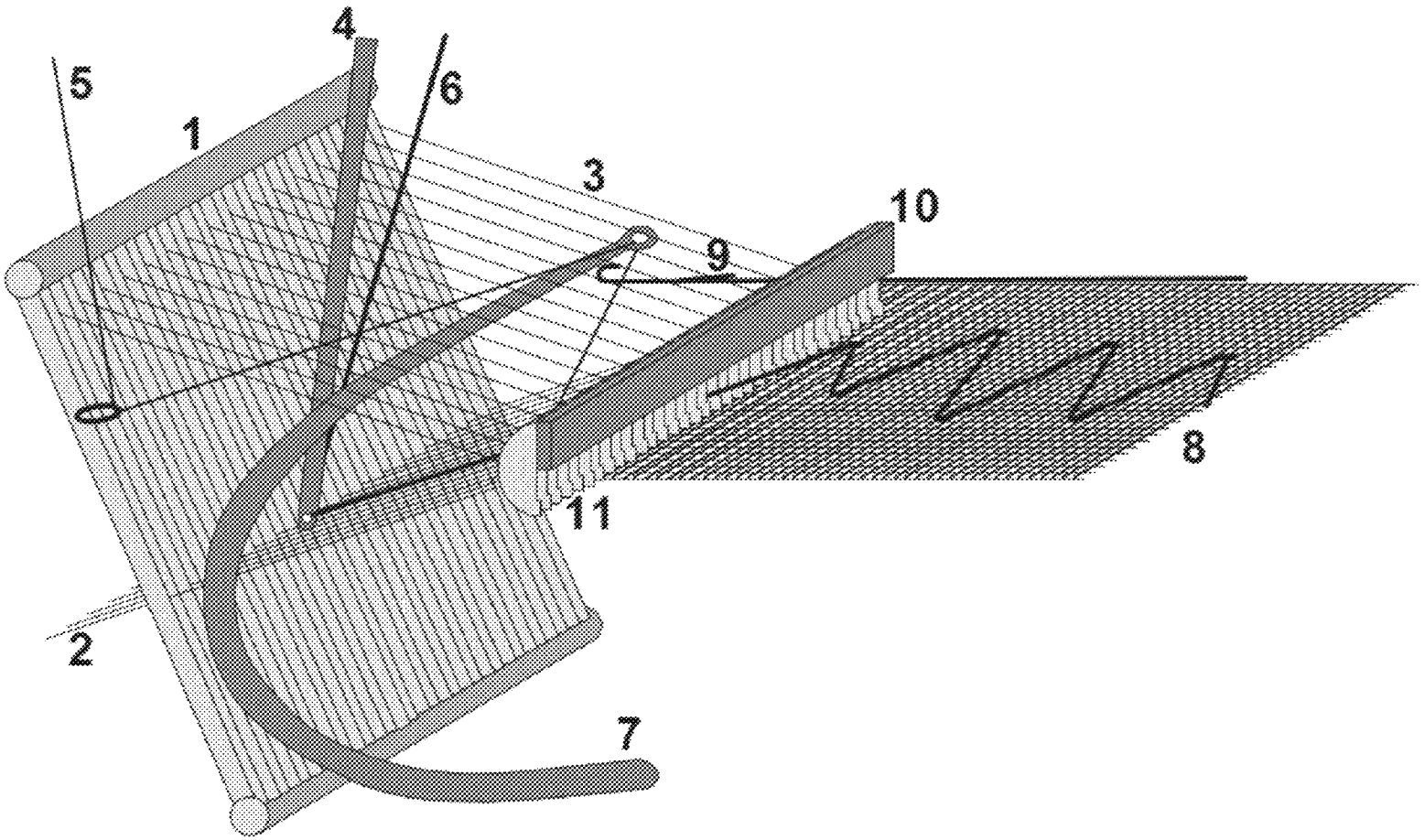
FIG. 7 the weaving loom according to FIG. 1, wherein the weft thread has reached the knitting needle for setting the selvage.
Figure 8:
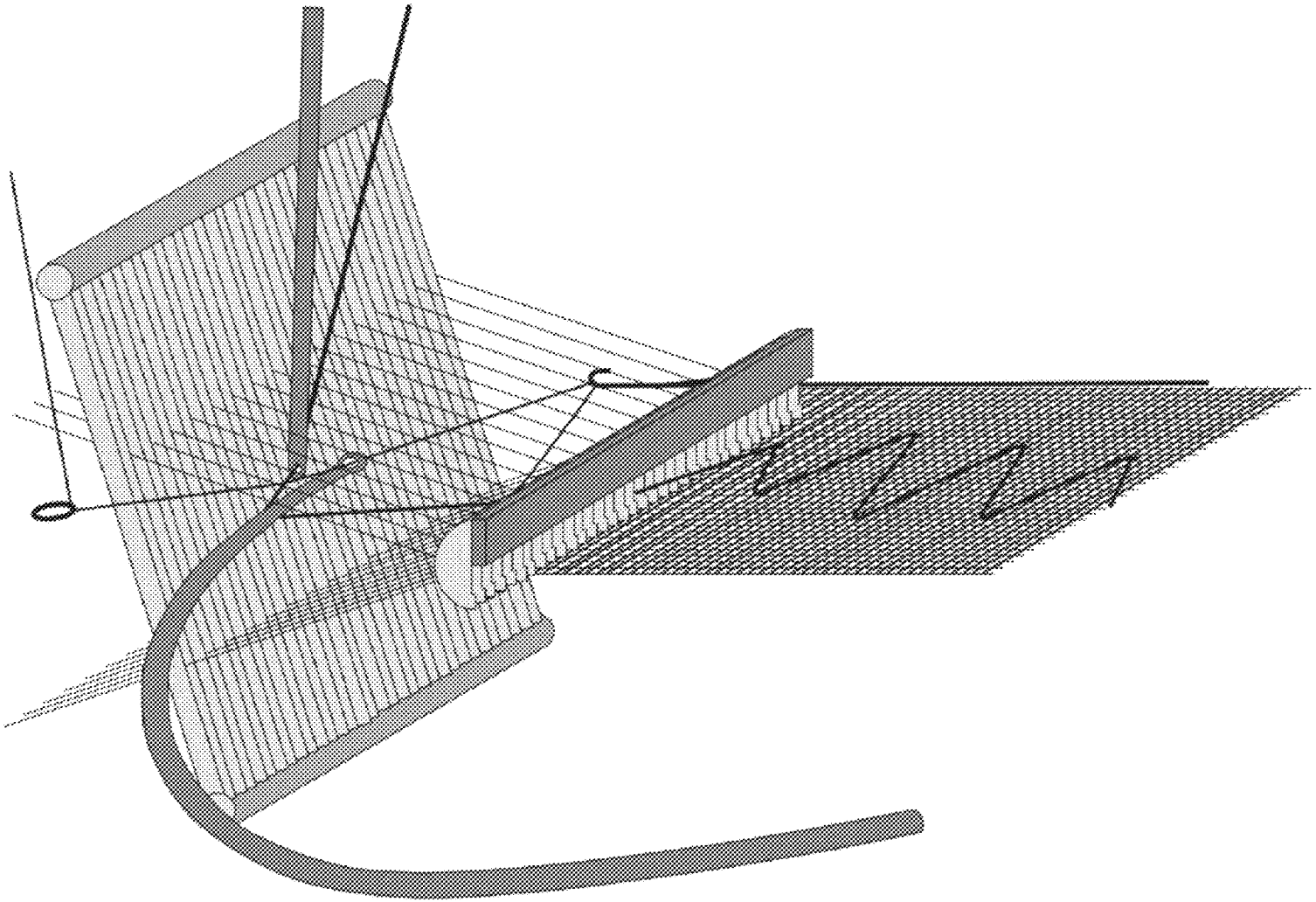
FIG. 8 the weaving loom according to FIG. 1, wherein the reed moves again towards the stop position, the knitting needle for setting the selvage holds the weft thread, the weft needle moves again out of the shed and the dipping guide needle raises again.
Figure 9:
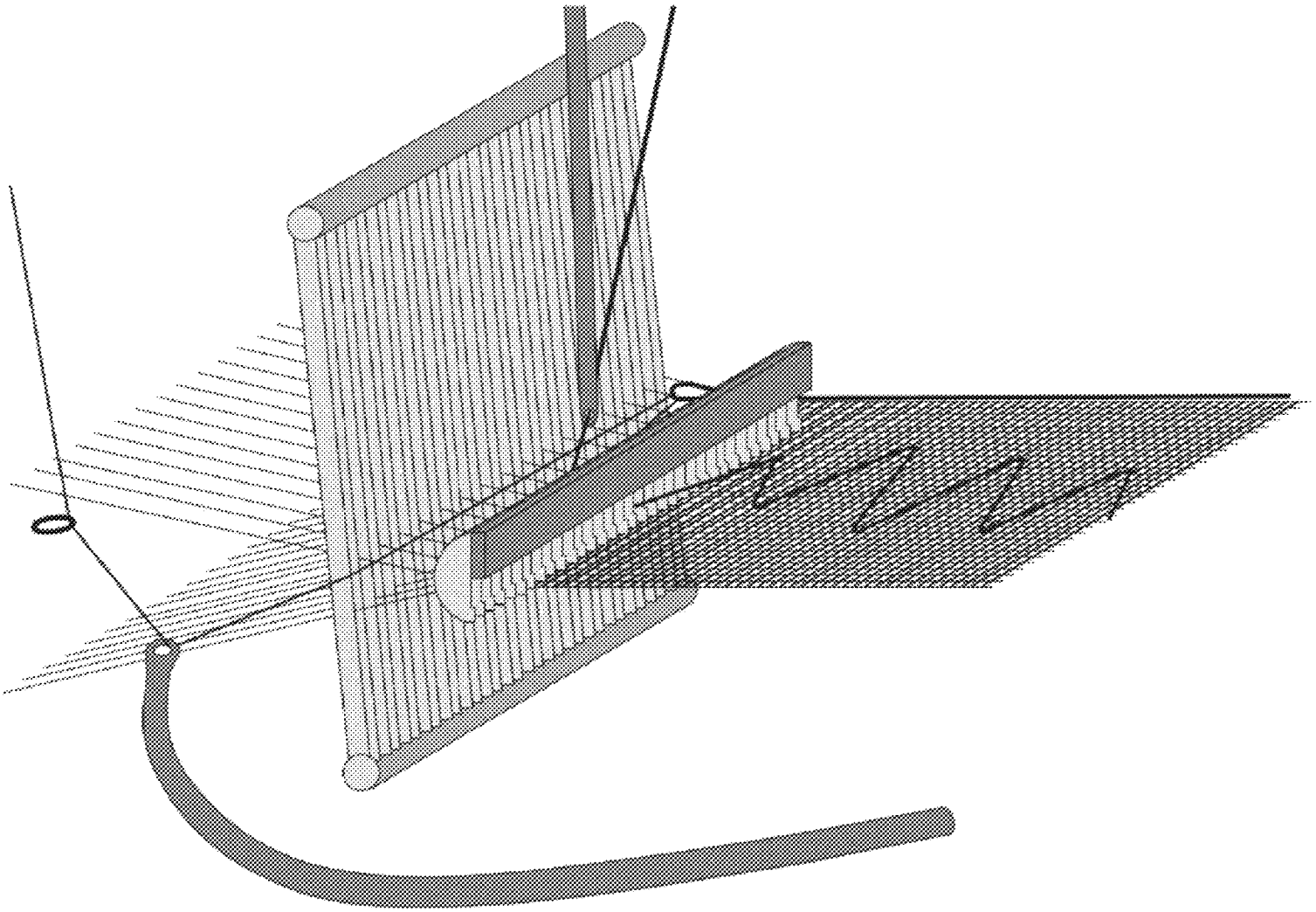
FIG. 9 the weaving loom according to FIG. 1, wherein the reed further moves towards the stop position, the knitting needle for setting the selvage has set the weft thread, the weft needle has again moved out of the shed and the dipping guide needle is again positioned above the shed.
Figure 11:
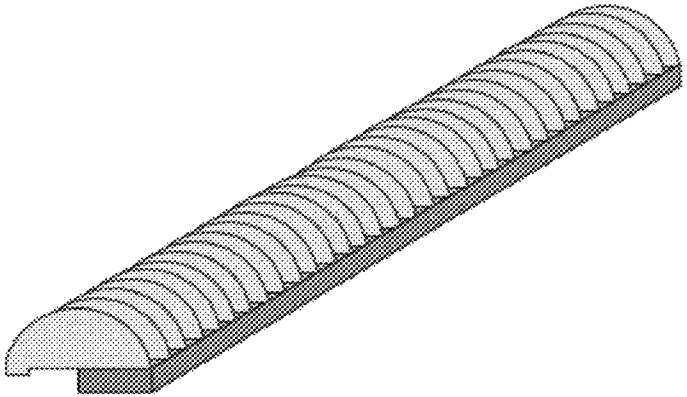
FIG. 11 the combing shaft pertaining to the weaving loom according to FIGS. 1 to 9, with the teeth pointing rearwards.
Figure 10:
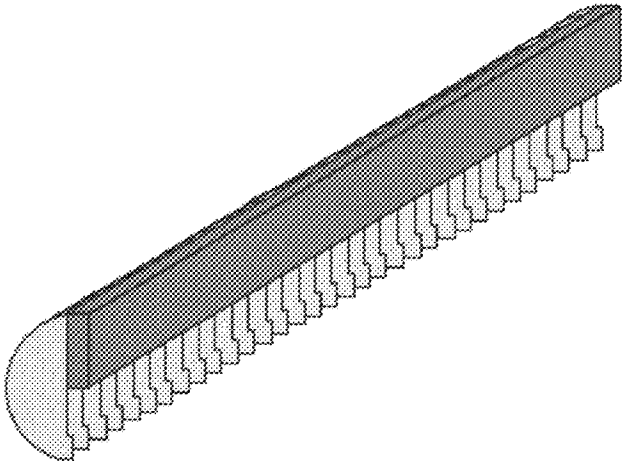
FIG. 10 the combing shaft pertaining to the weaving loom according to FIGS. 1 to 9, with the teeth pointing upwards.

The weaving loom shown in FIGS. 1 to 9 is a needle weaving loom, but the type of weft insertion is not decisive. The needle weaving loom comprises warp threads, which can form a lower shed and a upper shed, a weft needle with a weft thread, a dipping guide needle with a knitting or cover thread, a knitting needle for setting the selvage and, particularly, a combing shaft with protrusions for retaining the knitting or cover thread, and a guide bar, the combing shaft being both laterally slidable but also rotatable about its axis—in the exemplary embodiment by 70° to 100°, preferably about 70° to 80°. FIG. 1 shows the weaving loom substantially in a resting position. This is illustrated by the fact that no shed is formed. In FIG. 2, the combing shaft and the dipping guide needle are already displaced compared to FIG. 1. In FIG. 3, a lower shed and an upper shed are formed, and the dipping guide needle has been moved towards the combing shaft. In FIG. 4, the reed has moved away from the stop position, the dipping guide needle is ready for dipping in, and the combing shaft is rotated by about 80° about its axis. The weft needle has already approached the region between the upper shed and the lower shed. In FIG. 5, the reed is located further away from the stop position, and the dipping guide needle is already dipped in. In FIG. 6, the reed is even further away from the stop position, and the dipping guide needle is dipped in below the level of the weft needle. In FIG. 7, the weft thread has reached the knitting needle for setting the selvage. In FIG. 8, the reed again moves towards the stop position, the knitting needle for setting the selvage holds the weft thread while the weft needle again moves out of the shed and the dipping guide needle rises again. In the situation of FIG. 9, the weft-insertion, that is, one weaving cycle, has been completed. The reed further moves towards the stop position, the knitting needle for setting the selvage has set the weft thread, the weft needle has again moved out of the shed and the dipping guide needle is again above the shed. It should be noted that the representation according to FIGS. 1 to 9 is a simplified representation in which—for better understanding—only one dipping guide needle is shown. The rotatable combing shaft is shown in two different rotational positions in FIGS. 10 and 11.

Figure 12:
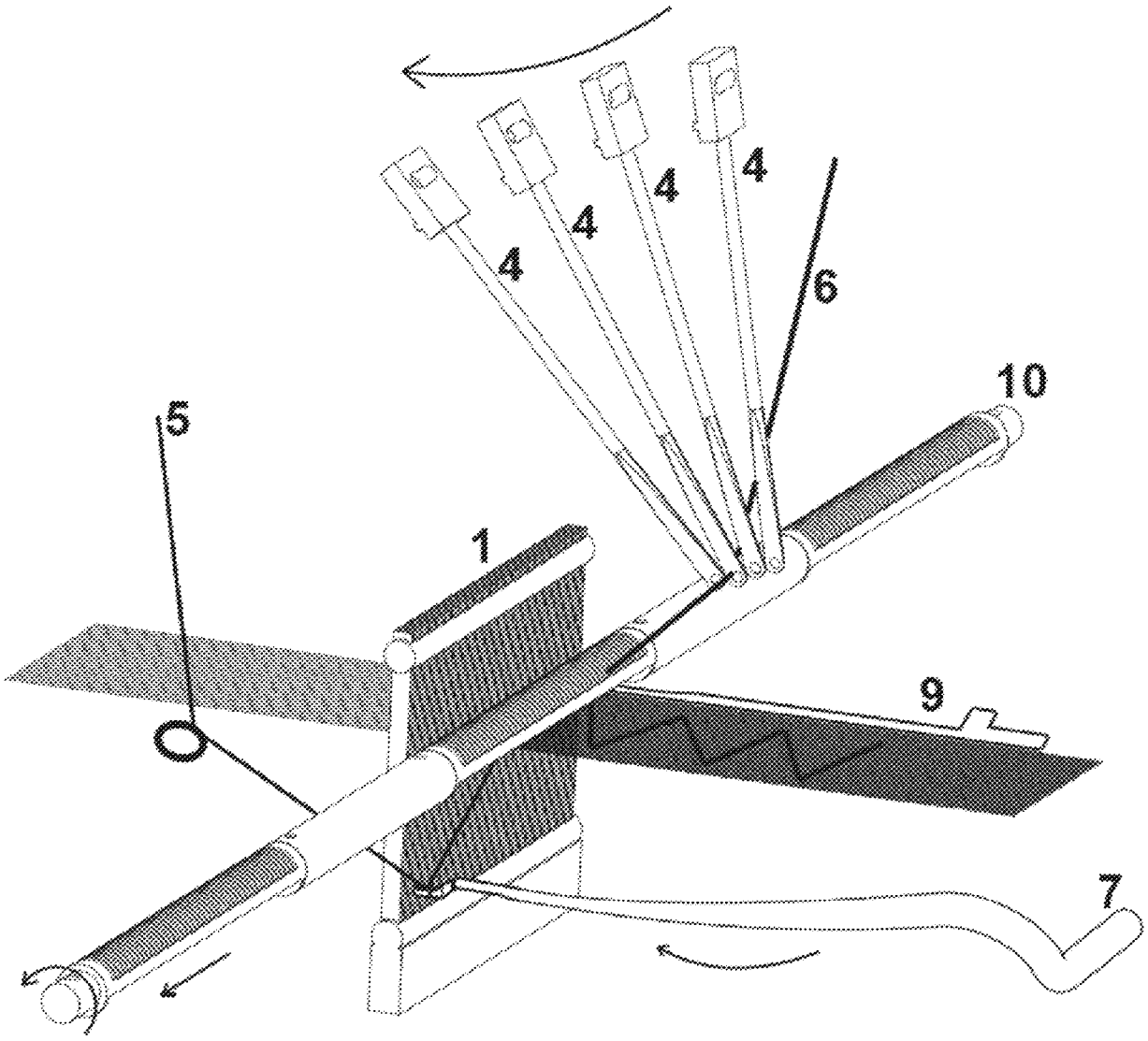
FIG. 12 a weaving loom, similar to the weaving loom in FIGS. 1 to 9, in a perspective view, wherein four guides with needle eye that are arranged one behind the other are shown, in a resting position, shown with an additional knitting thread.
Figure 13:
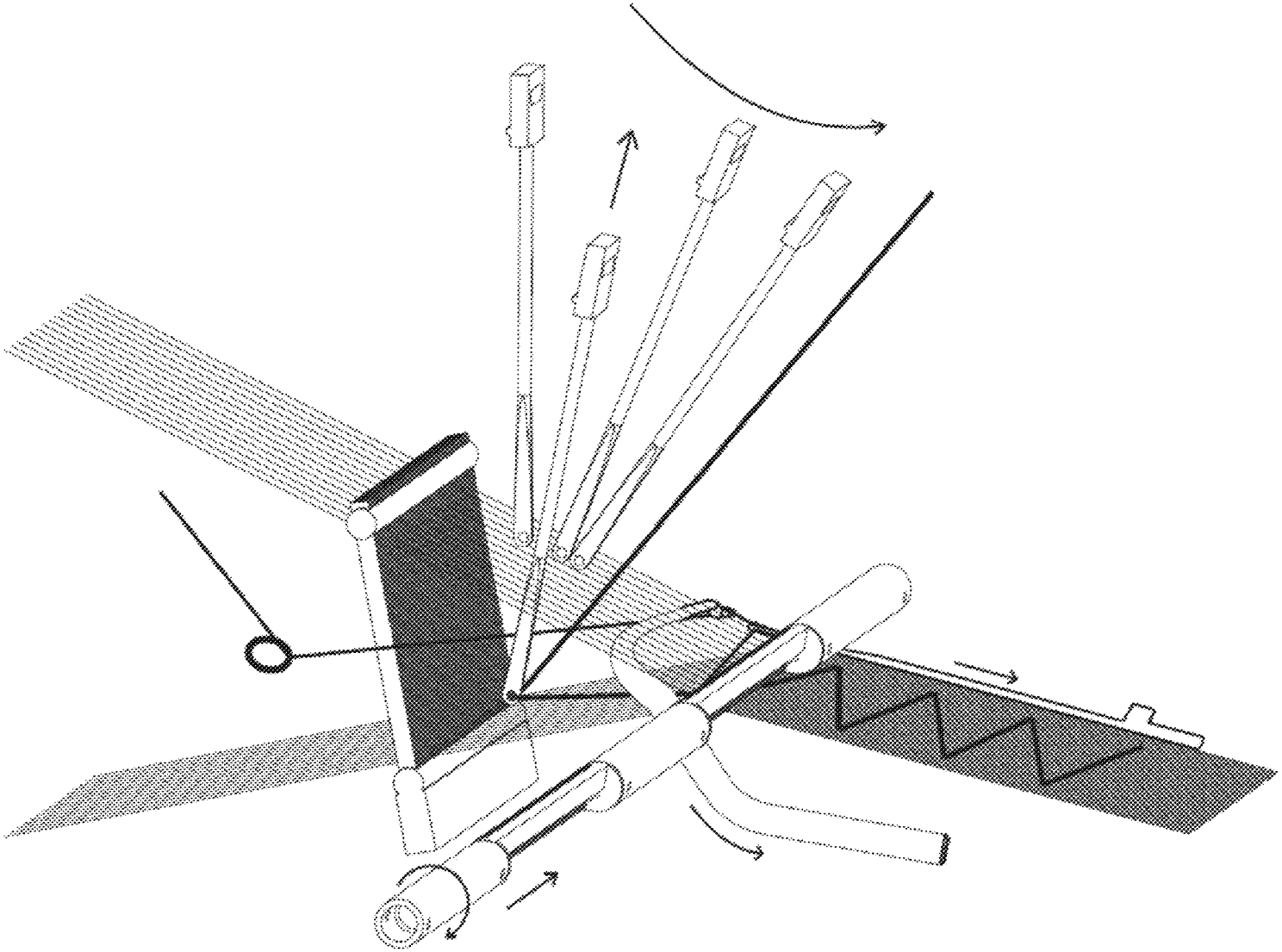
Figure 14:
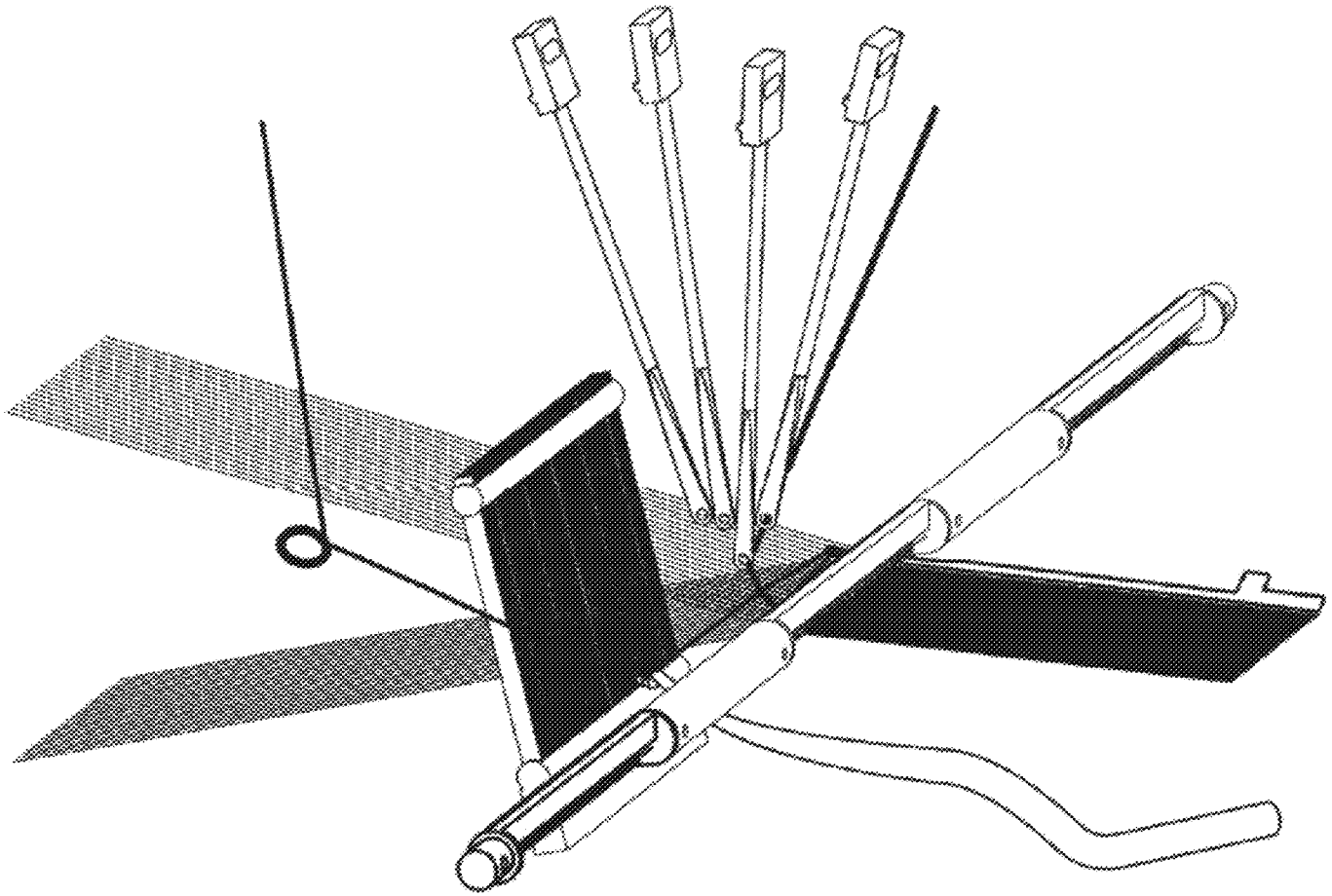
FIG. 14 the weaving loom according to FIG. 12, wherein a dipping guide needle is dipped into the shed and introduces the knitting thread.
Figure 15:
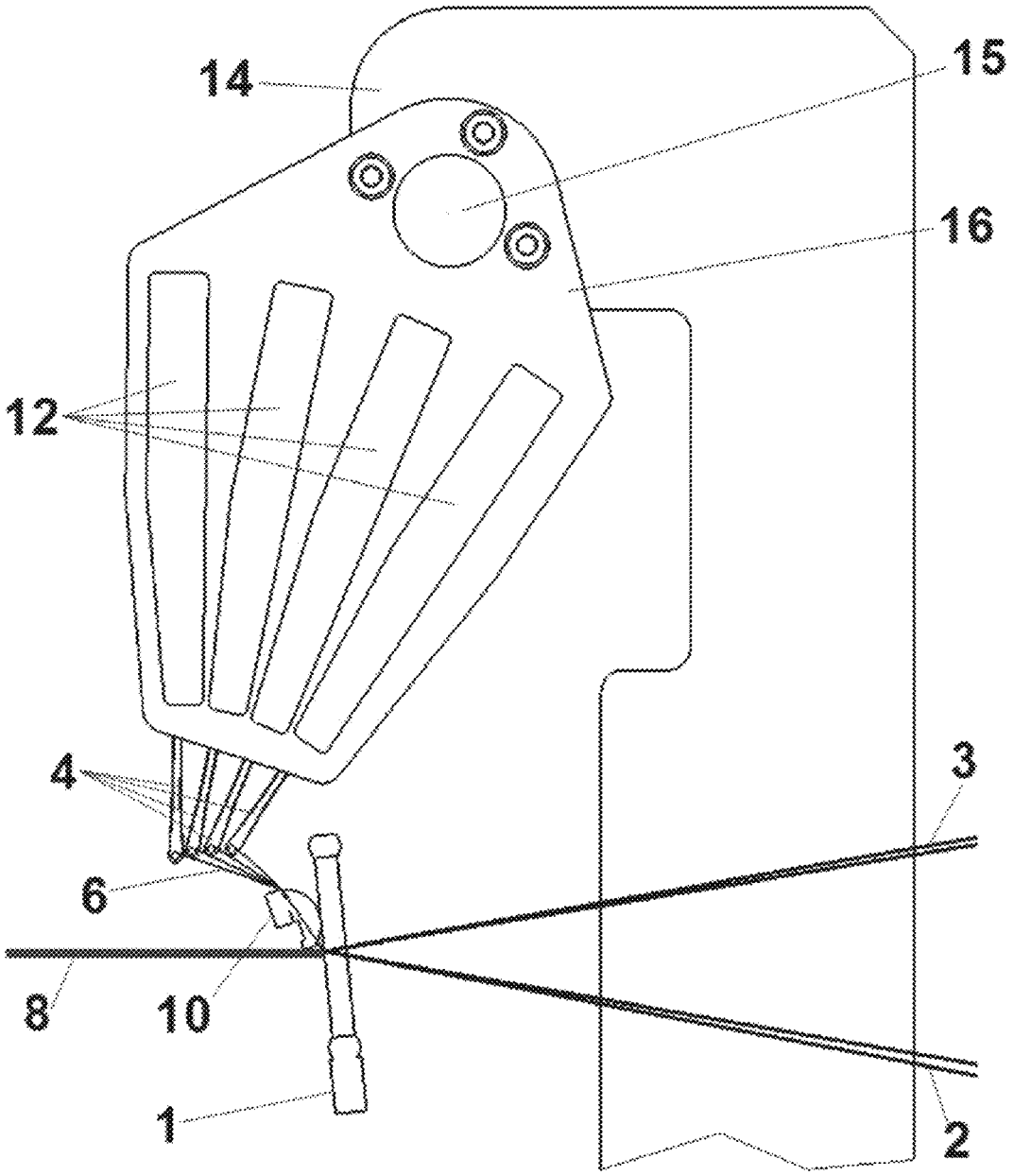
FIG. 15 the weaving loom according to FIG. 12, in the resting state, in a schematic view from the side.
Figure 16:
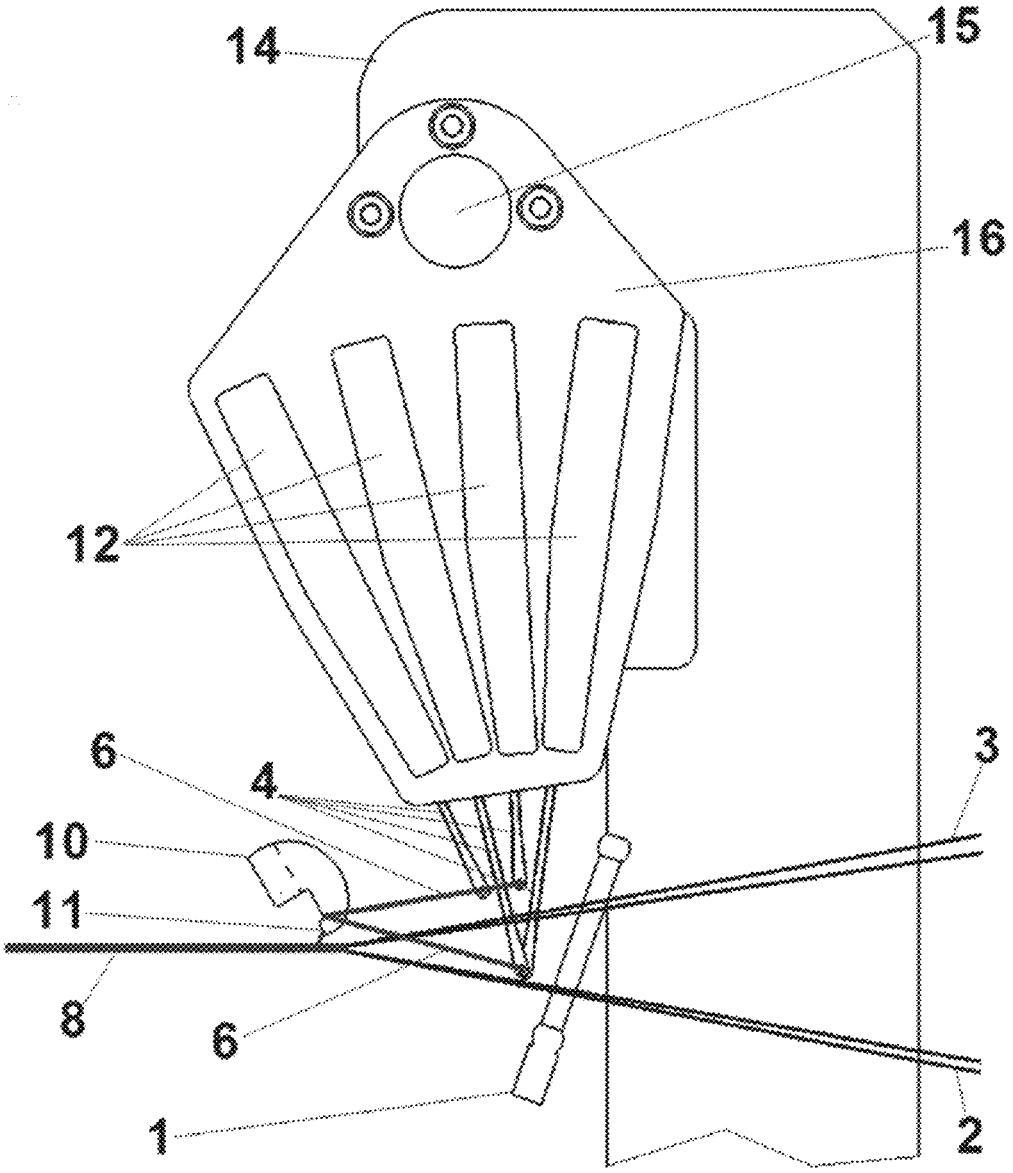
FIG. 16 the weaving loom according to FIG. 14, wherein a guide is dipped into the shed and introduces the knitting thread, in a schematic view from the side.
Figure 17:
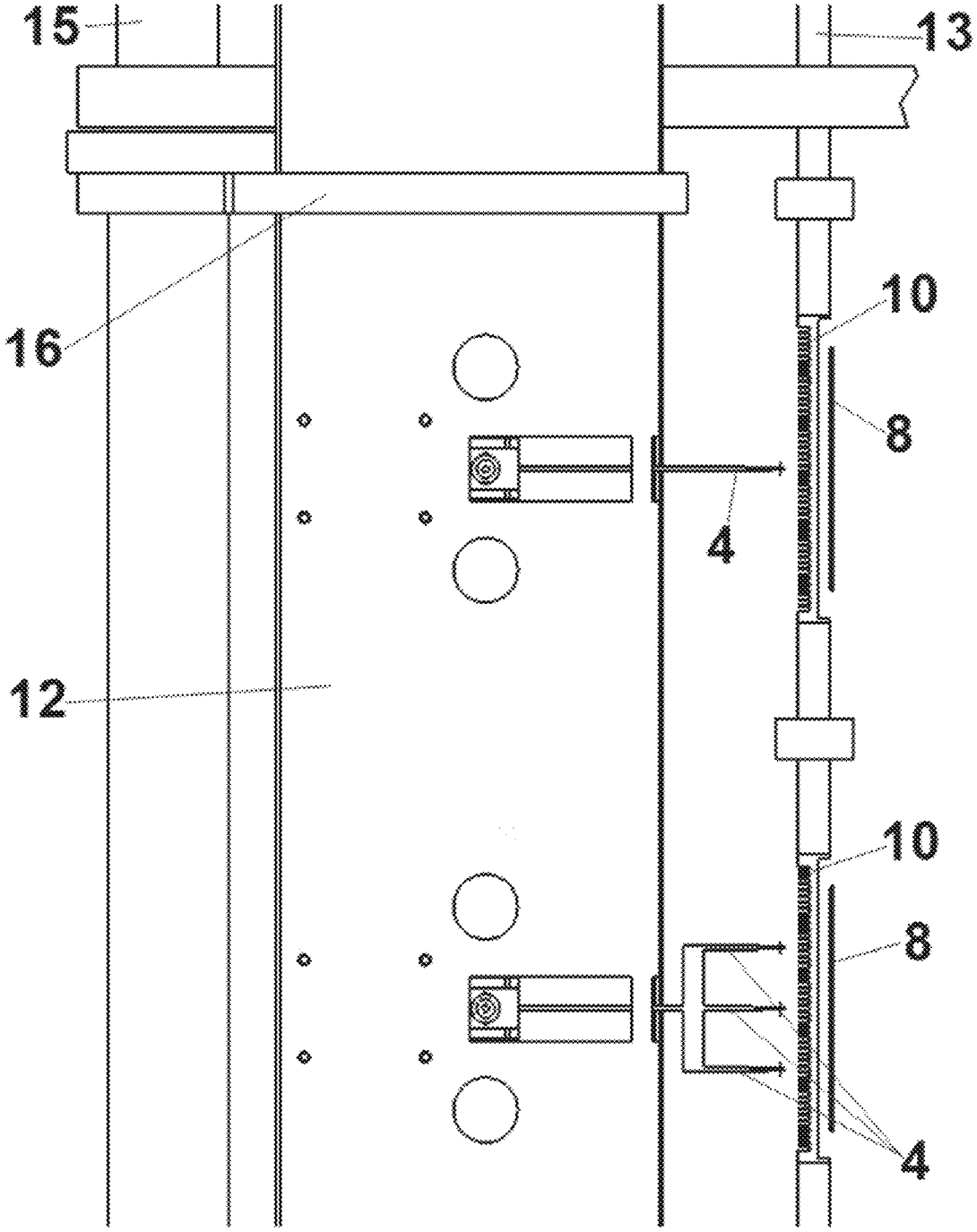
FIG. 17 a weaving loom according to a further embodiment of the present invention, in which two guide bars for weaving two ribbons arranged adjacent to each other are shown, each of the guide bars comprising one triple guide needle each assigned to a respective combing shaft so as to weave onto each of the ribbons three appliqués arranged at a fixed distance.

A weaving loom in which four dipping guide needles are arranged one behind the other is shown in FIG. 12 and shall be described hereinbelow. In FIG. 12, this weaving loom is shown substantially in a resting state. In FIG. 13 the weaving loom is then ready to introduce the knitting or cover thread. The weft needle is still outside the shed already formed, and the reed 1 is in the starting position. For simplicity, only one of the dipping guide needles 4 is shown with a knitting or cover thread 6 threaded in. In actual operation, the other dipping guide needles 4 can—but need not—be also provided each with a knitting or cover thread. The combing shaft 10 is in a position in which it is ready to incorporate the knitting or cover thread 6 for entraining the same. In FIG. 13, the weaving loom according to FIG. 12 is shown at a point of time when the dipping guide needle has been dipped into the shed and introduces the knitting thread. The weft needle is guided through the shed. FIG. 15 shows from sideways the weaving loom with dipping guide needle 4 dipped in, while FIG. 16 shows the same in a state in which the reed 1 is stopped, the dipping guide needle 4 is again in the upper position and the combing shaft 10 is twisted in such manner that it retains the knitting or cover thread 6 by a transverse movement of the guide bar. In FIGS. 15 and 16, there is shown the embodiment of the guide bar disposed on a holder 14 and rotatable about the guide bar axis 15 by means of a guide bar 1.

Figure 18:
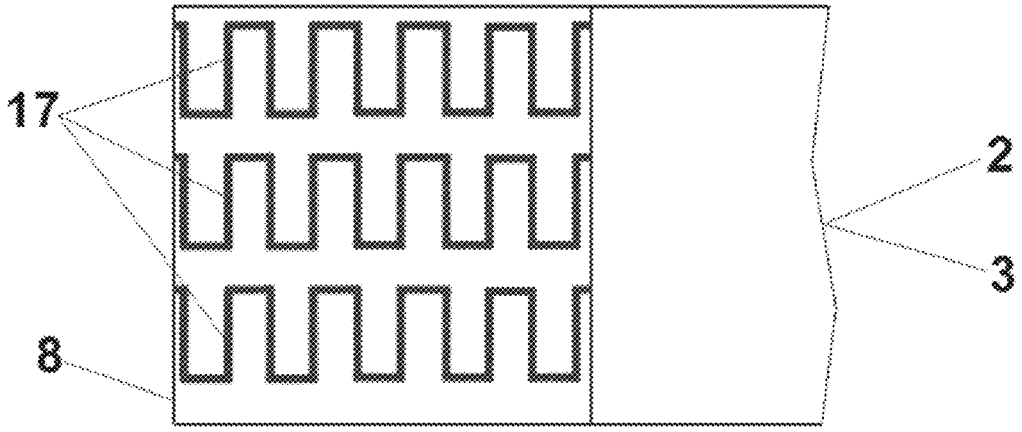
FIG. 18 a typical appliqué that is produced with a weaving loom according to FIG. 17.

In FIG. 16, there is shown a weaving loom according to a further exemplary embodiment of the present invention in which two guide bars for weaving two ribbons arranged adjacent to each other are shown, wherein each of the guide bars comprises one triple guide needle that is assigned to a respective combing shaft so as to weave onto each of the ribbons three appliqués arranged at a fixed distance. FIG. 18 then shows a typical appliqué 17 that is produced with such a weaving loom.

Figure 19:
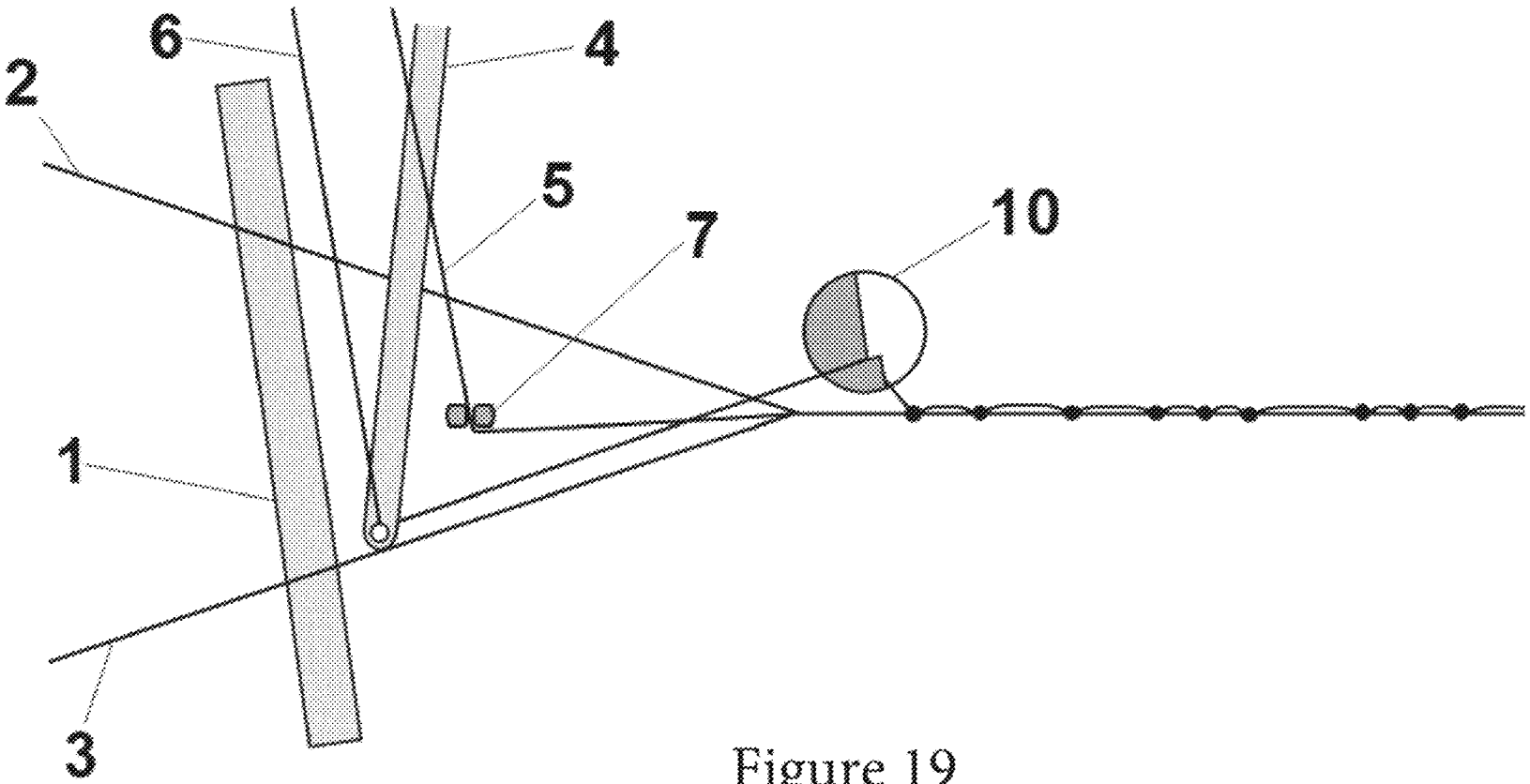
FIG. 19 a view of the function of the combing shaft, from sideways.
Figure 20:
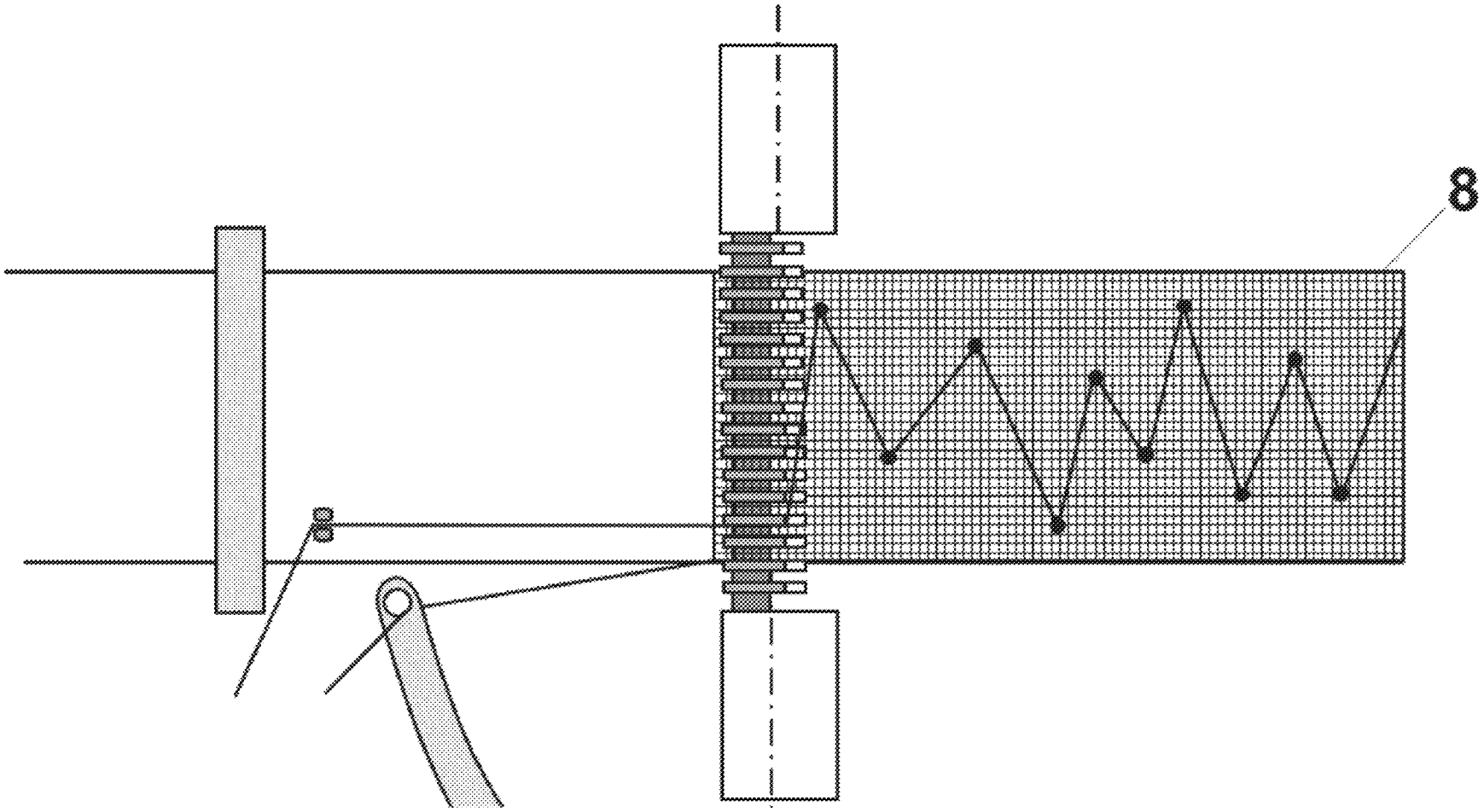
FIG. 20 a view according to FIG. 19, from above.

In FIG. 19, the function of the combing shaft 10 is shown. The combing shaft 10 is located on the side of the product closely behind the stop line of the reed and is capable to either hold the knitting thread 6 by means of protrusions 11 or to release the same—just by a rotation. The incorporated threads are retained in a rotational position of the comb as long as the weft-insertion organ has reliably moved through the knitting thread. Without the protrusions 11 the knitting thread would slip off from the teeth of the combing shaft if the protrusions 11 on the tooth tip were not to retain it. The knitting thread would then suddenly come to lie diagonally across the warp, and the knitting needle loop formed by the dipping guide needle would become so small that the weft-insertion organ could not be moved therethrough in a reliable manner. This arrangement ensures process reliability, and in particular protects the knitting thread which—for example as an antenna thread—should not be subjected to substantial loads. In FIG. 20, this relationship is again shown from above.

LIST OF REFERENCE NUMERALS

1 reed
2 warp thread lower shed
3 warp thread upper shed
4 dipping guide needle
5 weft thread
6 knitting or cover thread
7 weft needle
8 woven ribbon with incorporated effects
9 knitting needle for setting the selvage
10 combing shaft
11 protrusions at the combing shaft
12 guide bar
13 axis of the combing shaft
14 holder
15 axis of the guide bar
16 guiding of the guide bar
17 woven product with triple appliqué

The invention claimed is:

1. A weaving loom for producing a woven material with incorporated knitting threads, comprising a shed forming device for forming a shed constituted by warp threads with at least an upper shed and a lower shed, a weft-insertion device for inserting weft-threads, a reed for stopping of inserted weft-threads, a device for incorporating at least two knitting threads, wherein the device for incorporating the knitting threads comprises, for each knitting thread, the following:

a feeding device for the knitting thread, for each knitting thread a dipping guide needle comprising a thread guiding eye for the knitting thread which can be dipped between warp threads into the shed all the way below the insertion path of the weft-insertion device, wherein each of the dipping guide needles is slidingly arranged transversely to the warp direction, whereby each of the dipping guide needles can be moved across the width of the woven material, characterized by comprising a combing shaft comprising a plurality of teeth with intermediate spaces arranged therebetween for guiding the knitting threads, wherein the combing shaft comprising a plurality of teeth is arranged transversely to the direction of the warp thread behind the stop position of the reed, a device for moving the combing shaft transversely to the direction of the warp thread, further, a device for rotating the combing shaft around an axis in the direction of the warp thread, wherein the teeth of the combing shaft comprise means, which are designed in such manner that the teeth can retain the knitting threads in at least one rotational position of the combing shaft.

2. The weaving loom according to claim 1, characterized in that the teeth of the combing shaft are arranged adjacent to each other at a fixed distance.

3. The weaving loom according to claim 1, characterized in that at least two dipping guide needles are arranged adjacent to each other in the direction of the weft thread.

4. The weaving loom according to claim 3, characterized in that the at least two dipping guide needles are arranged adjacent to each other at a fixed distance.

5. The weaving loom according to claim 1, characterized in that at least two dipping guide needles are arranged one behind the other in the direction of the weft thread, wherein the dipping guide needles arranged one behind the other are independently movable transversely to the direction of the warp thread.

6. The weaving loom according to claim 1, characterized in that the movement of the dipping guide needle in weft direction is provided mechanically, pneumatically or electromechanically.

7. The weaving loom according to claim 1, characterized in that the dipping movement of the dipping guide needle is provided mechanically, pneumatically or electromechanically.

8. The weaving loom according to claim 1, characterized in that the movement of the combing shaft in weft direction is provided mechanically, pneumatically or electromechanically.

9. The weaving loom according to claim 1, characterized in that the rotary movement of the combing shaft is provided mechanically, pneumatically or electromechanically.

10. The weaving loom according to claim 1 wherein the warp thread means comprises protrusions.

11. The weaving loom according to claim 1, characterized in that the teeth of the combing shaft are arranged adjacent to each other at an equal distance.

12. The weaving loom according to claim 2, characterized in that at least two dipping guide needles are arranged adjacent to each other in the direction of the weft thread.

13. The weaving loom according to claim 12, characterized in that the at least two dipping guide needles are arranged adjacent to each other at a fixed distance.

14. The weaving loom according to claim 12, characterized in that at least two dipping guide needles are arranged one behind the other in the direction of the weft thread, wherein the dipping guide needles arranged one behind the other are independently movable transversely to the direction of the warp thread.

15. The weaving loom according to claim 2, characterized in that at least two dipping guide needles are arranged one behind the other in the direction of the weft thread, wherein the dipping guide needles arranged one behind the other are independently movable transversely to the direction of the warp thread.

16. The weaving loom according to claim 3, characterized in that at least two dipping guide needles are arranged one behind the other in the direction of the weft thread, wherein the dipping guide needles arranged one behind the other are independently movable transversely to the direction of the warp thread.

17. The weaving loom according to claim 4, characterized in that at least two dipping guide needles are arranged one behind the other in the direction of the weft thread, wherein the dipping guide needles arranged one behind the other are independently movable transversely to the direction of the warp thread.

18. The weaving loom according to claim 2, characterized in that the movement of the dipping guide needle in weft direction is provided mechanically, pneumatically or electromechanically.

19. The weaving loom according to claim 3, characterized in that the movement of the dipping guide needle in weft direction is provided mechanically, pneumatically or electromechanically.

20. The weaving loom according to claim 4, characterized in that the movement of the dipping guide needle in weft direction is provided mechanically, pneumatically or electromechanically.

21. The weaving loom according to claim 5, characterized in that the movement of the dipping guide needle in weft direction is provided mechanically, pneumatically or electromechanically.

* * * * *